US007878850B2

(12) United States Patent
Wu

(10) Patent No.: US 7,878,850 B2
(45) Date of Patent: Feb. 1, 2011

(54) CABLE CONNECTOR ASSEMBLY WITH GROUNDING DEVICE

(75) Inventor: Chun-Kwan Wu, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/569,902

(22) Filed: Sep. 30, 2009

(65) Prior Publication Data

US 2010/0221933 A1 Sep. 2, 2010

(30) Foreign Application Priority Data

Mar. 2, 2009 (TW) ..... 98106665 A

(51) Int. Cl.
*H01R 9/05* (2006.01)

(52) U.S. Cl. ..... 439/579; 439/581; 439/497

(58) Field of Classification Search ..... 439/495, 439/497, 95, 98, 579, 581
See application file for complete search history.

(56) References Cited

U.S. PATENT DOCUMENTS 5,725,387 A * 3/1998 O'Sullivan et al. ..... 439/98
6,250,959 B1 * 6/2001 Yamaguchi et al. ..... 439/578
6,524,135 B1 * 2/2003 Feldman et al. ..... 439/607.46
6,612,870 B1 * 9/2003 Rauscent ..... 439/607.44
6,641,435 B1 11/2003 Hai
6,655,992 B1 * 12/2003 Ko ..... 439/579
7,465,186 B2 * 12/2008 Yotsutani ..... 439/497
2005/0106931 A1 * 5/2005 Yagi et al. ..... 439/495
2008/0139046 A1 * 6/2008 Semba et al. ..... 439/579
2010/0081302 A1 * 4/2010 Atkinson et al. ..... 439/98
2010/0144199 A1 * 6/2010 Wu ..... 439/578

* cited by examiner

*Primary Examiner*—Edwin A. Leon
*Assistant Examiner*—Larisa Tsukerman
(74) *Attorney, Agent, or Firm*—Wei Te Chung; Andrew C. Cheng; Ming Chieh Chang

(57) ABSTRACT

A cable connector (100) includes an insulative housing (30), a number of terminals (70) received in the insulative housing, a metal cover (10) shielding the insulative housing, a number of cables (50) and a grounding plate (90). The terminals include a number of signal pins (70B, 70D) and a number of grounding pins (70A, 70C, 70E). The cables correspondingly connect with the terminals. Each cable includes a central conductor (507) and a braiding layer (503). The grounding plate mechanically and electrically connecting with the braiding layers of the cables, the grounding pins and the metal cover.

13 Claims, 11 Drawing Sheets

CABLE CONNECTOR ASSEMBLY WITH GROUNDING DEVICE

CROSS-REFERENCE TO RELATED APPLICATIONS

This patent application relates to a co-pending U.S. Patent Application entitled "CABLE CONNECTOR ASSEMBLY", which has the same inventor and is assigned to the same assignee with this application.

BACKGROUND OF THE INVENTION

1. Field of the Invention

The present invention relates generally to a cable connector assembly, and more particularly to a cable connector assembly having grounding structure.

2. Description of Related Arts

Micro coaxial cable connectors are widely used in mobile phone, which is well known to persons skilled in the art. The traditional micro coaxial cable connector transmits signals with lower frequency depending upon its own structure. Accompanying with multi-functions of people, such as Global Position System (GPS), the micro coaxial cable connector is asked to transmit signals with higher frequency. Higher frequent signal transmission may generate electrostatic therein. Therefore, the micro coaxial cable connectors with better grounding performance are needed.

U.S. Pat. No. 6,641,435, issued on Nov. 4, 2003 and entitled with "Vertically mated micro coaxial cable connector assembly", discloses a cable connector assembly including a cable connector and a plurality of micro coaxial cables electrically connecting with the cable connector. The cable connector includes an insulative housing, a plurality of contacts received in the insulative housing, and a shielding shell enclosing the insulative housing. Each of the cables includes a central conductor, an insulative layer enclosing the central conduct, and a metallic braiding layer enclosing the insulative layer. The shielding shell defines a plurality of spring arms mechanically and electrically connecting with the corresponding metallic braiding layers of the cables. Therefore, an electrical connection between the shielding shell and the metallic braiding layers of the cables is established for grounding. However, the electrical connection is so unreliable that it is easy to be broken down and EMI is difficulty prevented.

Hence, a cable connector assembly having better grounding structure is desired.

SUMMARY OF THE INVENTION

Accordingly, an object of the present invention is to provide a cable connector assembly having better grounding performance.

To achieve the above object, A cable connector includes an insulative housing, a number of terminals received in the insulative housing, a metal cover shielding the insulative housing, a number of cables and a grounding plate. The terminals include a number of signal pins and a number of grounding pins. The cables correspondingly connect with the terminals. Each cable includes a central conductor and a braiding layer. The grounding plate mechanically and electrically connecting with the braiding layers of the cables, the grounding pins and the metal cover.

Other objects, advantages and novel features of the invention will become more apparent from the following detailed description when taken in conjunction with the accompanying drawings.

DETAILED DESCRIPTION OF THE PREFERRED EMBODIMENT

Figure 1:
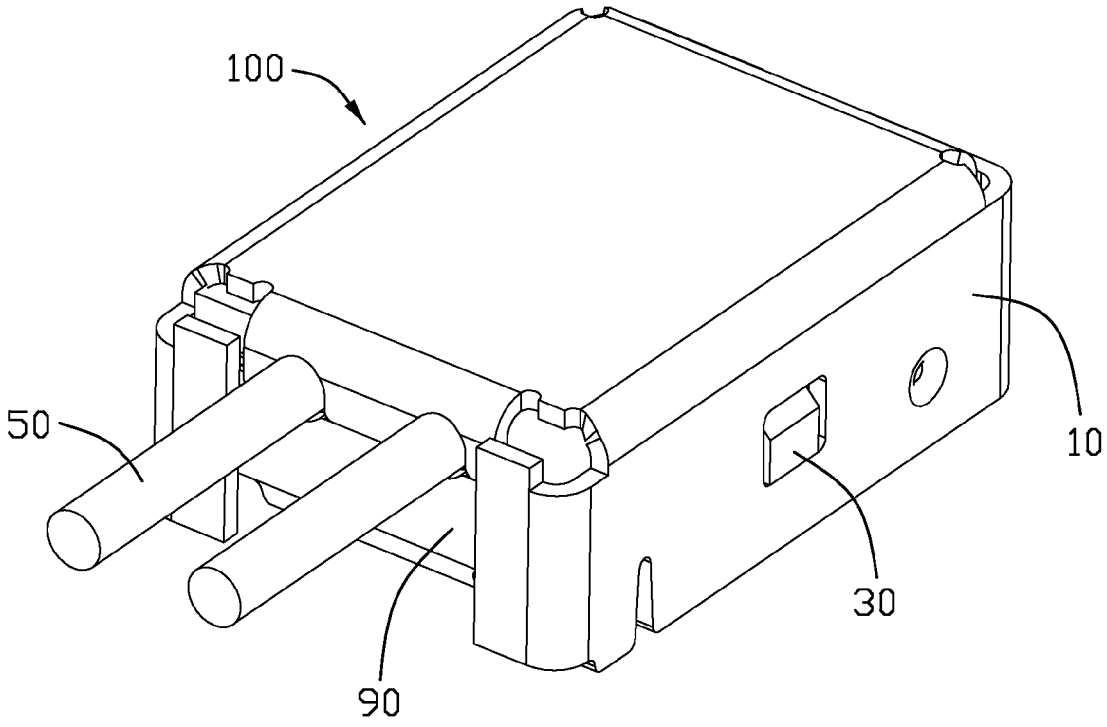
FIG. 1 is a perspective, assembled view of a cable connector constructed in accordance with the present invention of a cable connector assembly.

Referring to FIGS. 1-11, a cable connector assembly (not labeled) of the present invention comprises a cable connector 100 and a mating connector 200 coupled with the cable connector 100.

Referring to FIGS. 1-6, reference will now be made in detail to a preferred embodiment of the cable connector 100 as following. The cable connector 100 comprises an insulative housing 30, a plurality of terminals 70 received in the insulative housing 30, a metal cover 10 shielding the insulative housing 30, a plurality of cables 50 connecting to the terminals 70, and a grounding plate 90 being in connection with the terminals 70, the metal cover 10 and the cables 50 for grounding purpose.

Figure 4:
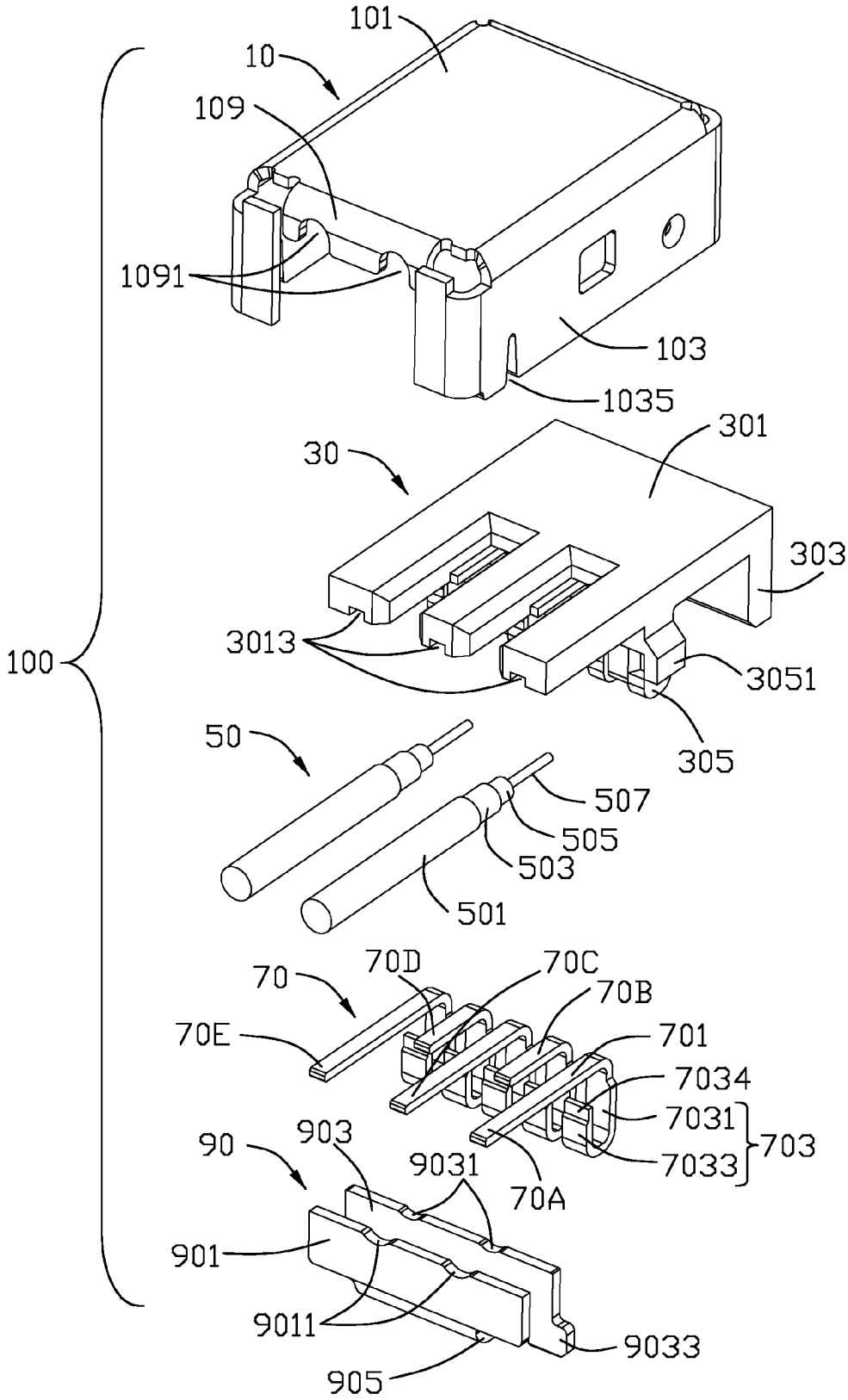
FIG. 4 is a perspective, exploded view of the cable connector of FIG. 1.
Figure 5:
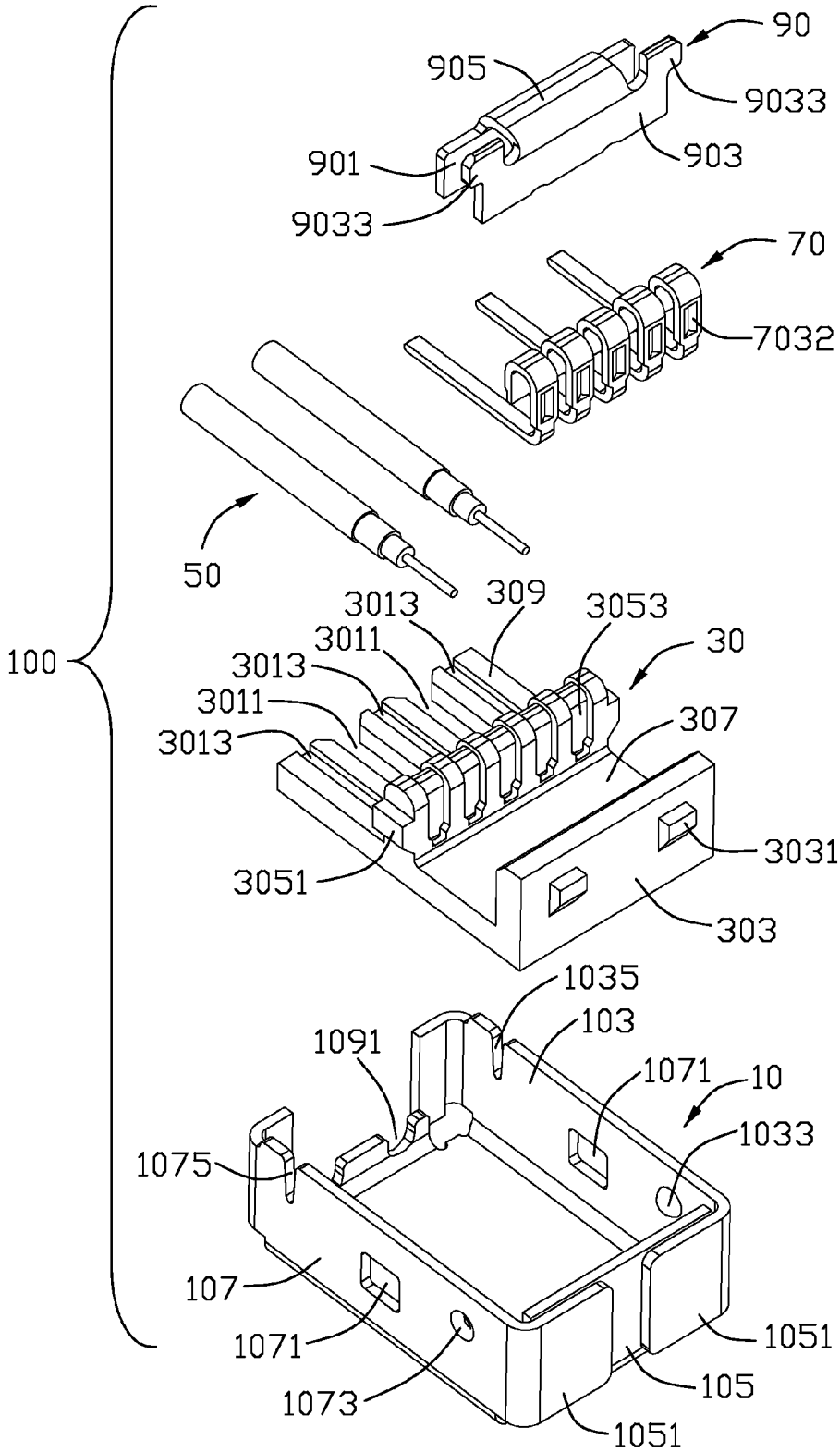
FIG. 5 is a view similar to FIG. 4 but taken from a different aspect.

Referring to FIGS. 4 and 5, the insulative housing 30 comprises a planar base portion 301 having a first end (not labeled) and an opposite second end (not labeled), a guiding portion 303 substantially and vertically extending from the first end of the base portion 301 for guiding the cable connector 110 to mate with the mating connector 200 in a right position, and a mating portion 305 substantially and vertically extending from a middle part of the base portion 301. The mating portion 305 is substantially parallel to the guiding portion 301 and especially extends along a same side as the guiding portion 301 relative to the base portion 301 to define a receiving channel 307 with three openings thereof. The base portion 301 and the mating portion 305 cooperatively define a receiving space 309 with four openings thereof, which is located in a neighborhood of the receiving channel 307. The guiding portion 303 forms a pair of first protrusions 3031 extending outwardly and forwardly therefrom while the mating portion 305 forms a pair of second protrusions 3051 extending laterally and outwardly for mating with the metal cover 10. Because the first protrusions 3031 and the second protrusions 3051 are just used for engagement between the insulative housing 30 and the metal cover 10, no essential difference is formed therebetween. The mating portion 305 is concaved from top surfaces thereof for several intervals as a plurality of terminal channels 3053. The terminals 70 straddle the mating portion 305 to be partly received in the terminal channels 3053. The base portion 301 defines a plurality of slits 3011 and a plurality of slots 3013 at the second side thereof. The slits 3011 are dilacerated from the base portion 301 while the slots 3013 are recessed from the base portion 301. Each slit 3011 is alternately located beside the slot 3013. Both the slits 3011 and the slots 3013 extend lengthwise to communicate with the terminal channels 3053.

Referring to FIGS. 2-6, the terminal 70 comprises three grounding pins 70A, 70C, 70E received in the slots 3013 and two signal pins 70B, 70D received in the slits 3011. Accordingly, the grounding pins 70A, 70C, 70E and the signal pins 70B, 70D are alternately located. The grounding pins 70A, 70C, 70E and the signal pins 70B, 70D have similar structures, each comprising a soldering portion 701 connecting with the cable 50 and an annular portion 703 extending vertically from the soldering portion 701 with a free end thereof extending towards the soldering portion 701. The annular portion 703 has a width larger than the soldering portion 701. The annular portion 703 comprises a first arm portion 7031 connecting with the soldering portion 701 and a second arm portion 7033 curvedly and inversely extending from the first arm portion 7031. The first arm portion 7031 recesses from an outer surface thereof to be a first contact portion 7032 and the second arm portion 7033 recesses at a free end thereof to be a second contact portion 7034. Taken a side view of the terminal 70, the first and second contact portion 7032, 7034 have opposite exposure. The grounding pins 70A, 70C, 70E differentiate from the signal pins 70B, 70D merely at that the soldering portions 701 of the grounding pins 70A, 70C, 70E are longer than the soldering portions 701 of the signal pins 70B, 70D.

Referring to FIGS. 1-6, the metal cover 10 is box-shaped structured and comprises a top wall 101, a left wall 107, a right wall 103, and a rear wall 105. The left wall 107, the right wall 103, and the rear wall 105 respectively and vertically extend from a left side, a right side, and a rear side of the top wall 101. The left and right walls 107, 103 define a pair of square-shaped fixing holes 1071, 1031 in middle parts thereof for receiving the second protrusions 3051 of the insulative housing 30. Furthermore, the left and right walls 107, 103 each form hemispherical heaves 1073, 1033 adjacent to the square-shaped fixing holes 1071, 1031. The hemispherical heaves 1073, 1033 are exposed in the receiving channel 307 for interference with the mating connector 200 when assembling. The metal cover 10 further forms a pair of peripheral walls 1051 respectively and integrally extending from the left and right walls 107, 103 and finally bending oppositely and inwardly to shield the rear wall 105. The top wall 101 forms an eave portion 109 bending vertically from a front side thereof. The eave portion 109 defines a plurality of grooves 1091 for the cable 50 going through. The left wall 107 and the right wall 103 define a pair of U-shaped cutouts 1075, 1035 adjacent to the eave portion 109 for positioning the grounding plate 90.

Figure 2:
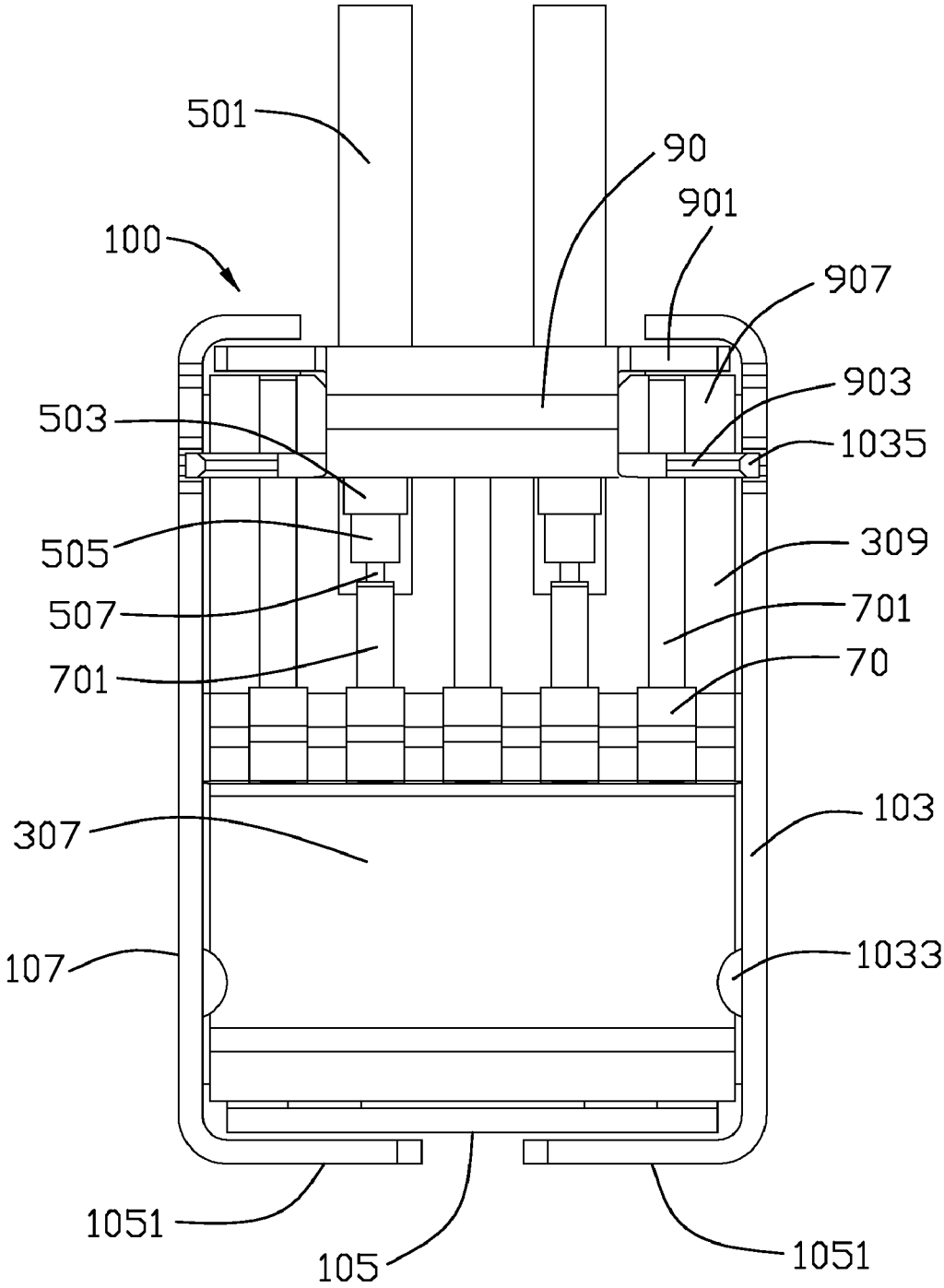
FIG. 2 is a bottom plan view of the cable connector of FIG. 1.
Figure 3:
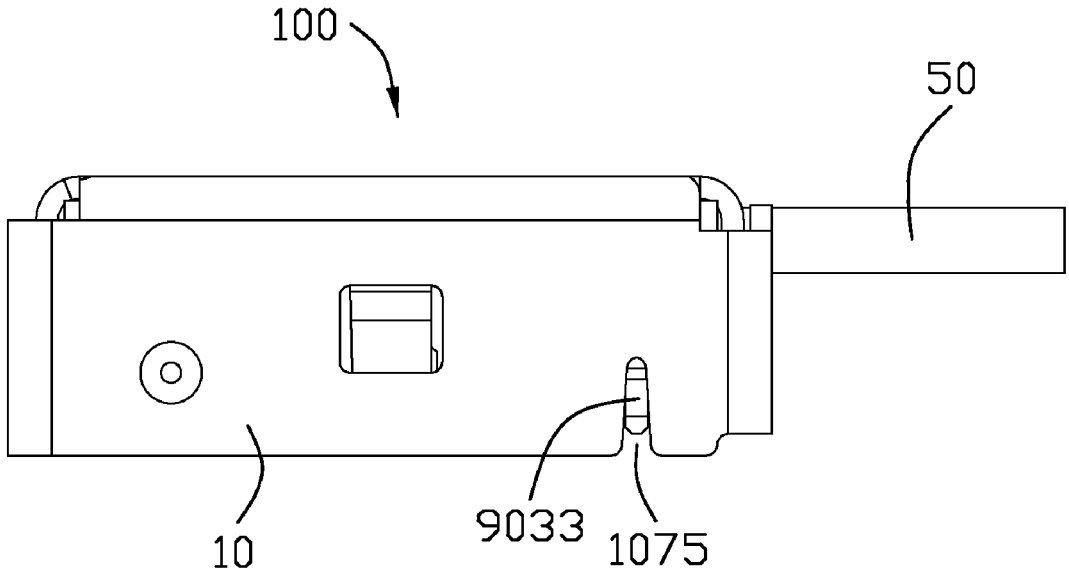
FIG. 3 is a side view of the cable connector of FIG. 1.
Figure 6:
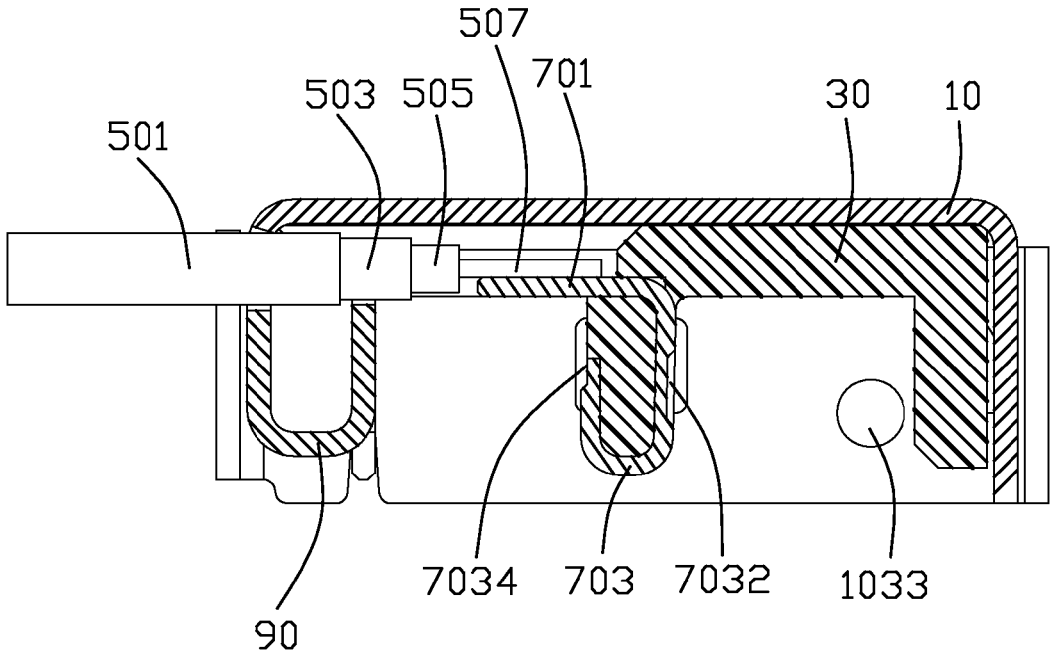
FIG. 6 is a cross-section view of the cable connector taken along line with the signal pins and the cables thereof.

Referring to FIGS. 2, 4 and 6, the cables 50 are micro coaxial cables, each comprising a central conductor 507 for signal transmission, an insulating layer 505 encircling the central conductor 507, a braiding layer 503 shrouding the insulating layer 505, and a jacket 501 wrapping the braiding layer 503. The cross sections of the central conductor 507, the insulating layer 505, the braiding layer 503, and the jacket 501 get larger and larger one by one. The cables 50 are partly received in the slits 3011 and partly extend out of the metal cover 10 through the grooves 1091. The central conductors 507 are soldered with the soldering portions 701 of the signal pins 70B, 70D.

Referring to FIGS. 4-5, the grounding plate 90 is substantially U-shaped structured. The grounding plate 90 comprises a first plate element 901, a second plate element 903 being parallel with the first plate element 90 and a joining element 905 connecting with the first and second plate elements 901, 903. The first and second plate elements 901, 903 respectively define a plurality of first recesses 9011 and a plurality of second recesses 9031 at a rear edge (not labeled) distant away from the joining element 905. The first and second recesses 9011, 9031 permit the cables 50 to go therethrough. The first recesses 9011 cooperate with the grooves 1091 to position the cables 50 therein. The second plate element 903 of the grounding plate 90 is pressed on the braiding layers 503 of the cables 50 and the grounding pins 70A, 70C, 70E to achieve mechanical and electrical connection. Emphatically, the second plate element 903 forms a pair of ear portions 9033 at an opposite edge (not labeled) close to the joining element 905 for being appropriately adapted in the U-shaped cutouts 1075, 1035 of the metal cover 10. Since the first and second plate elements 901, 903 have larger widths than the joining element 905, after assembling the grounding plate 90 onto the metal cover 10, the joining element 905 and the left wall 107, as well as the joining element 905 and the right wall 103, define two interspaces 907, through which electric colloid is injected to make sure that the cables 50 are tightly fixed in the grooves 1091 and the recesses 9011 by the metal cover 10 and the grounding plate 90.

Figure 7:
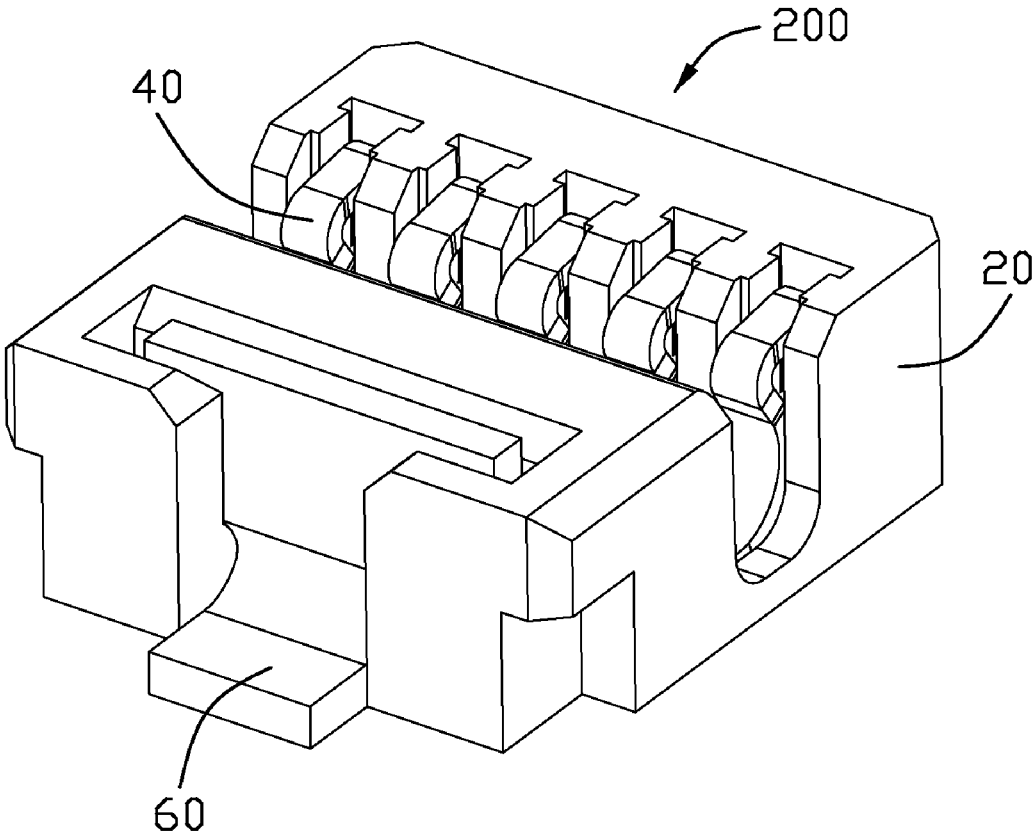
FIG. 7 is a perspective, assembled view of a mating connector coupled with the cable connector.

Following, please refer to FIGS. 7-9, reference will now be made in detail to a preferred embodiment of the mating connector 200. The mating connector 200 comprises an insulative base 20, a plurality of contacts 40 received in the insulative base 20 and a reinforcing element 60 fixed at a side of the insulative base 20.

Figure 8:
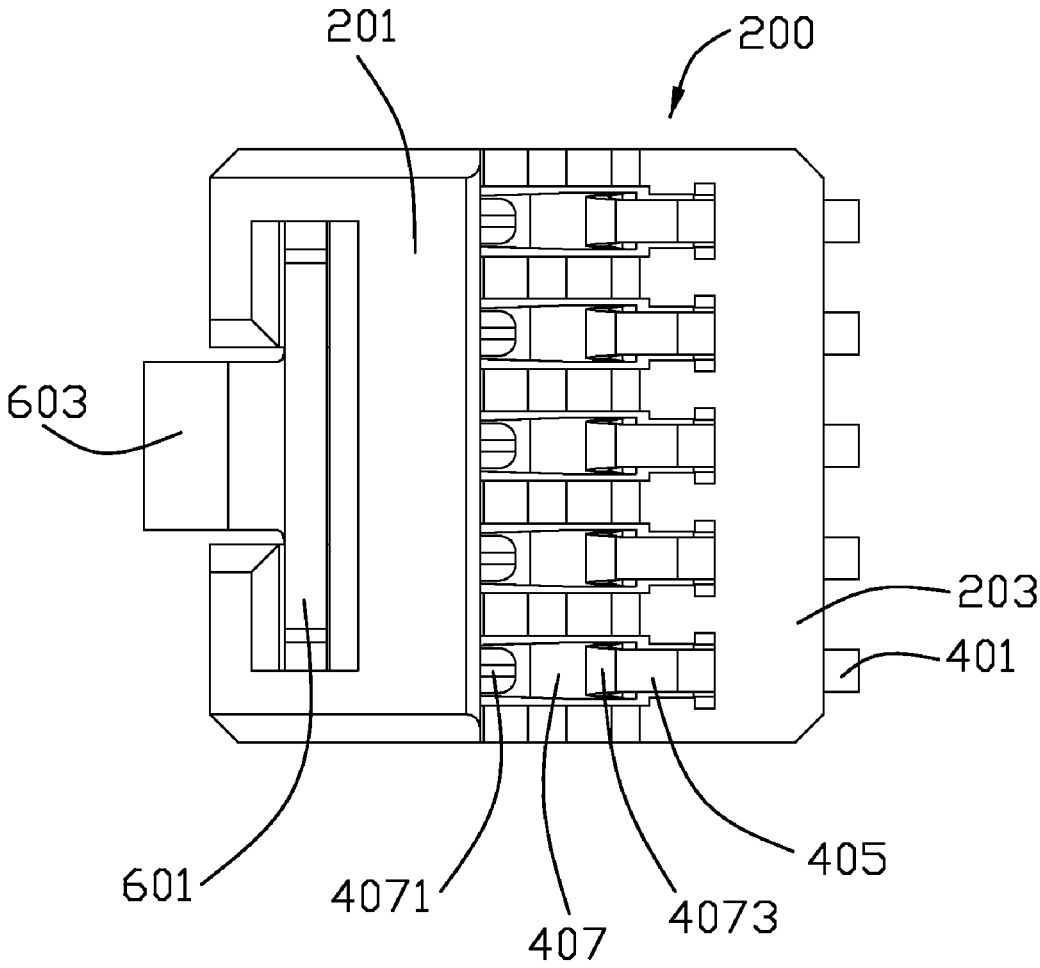
FIG. 8 is a top plan view of the mating connector of FIG. 7.
Figure 9:
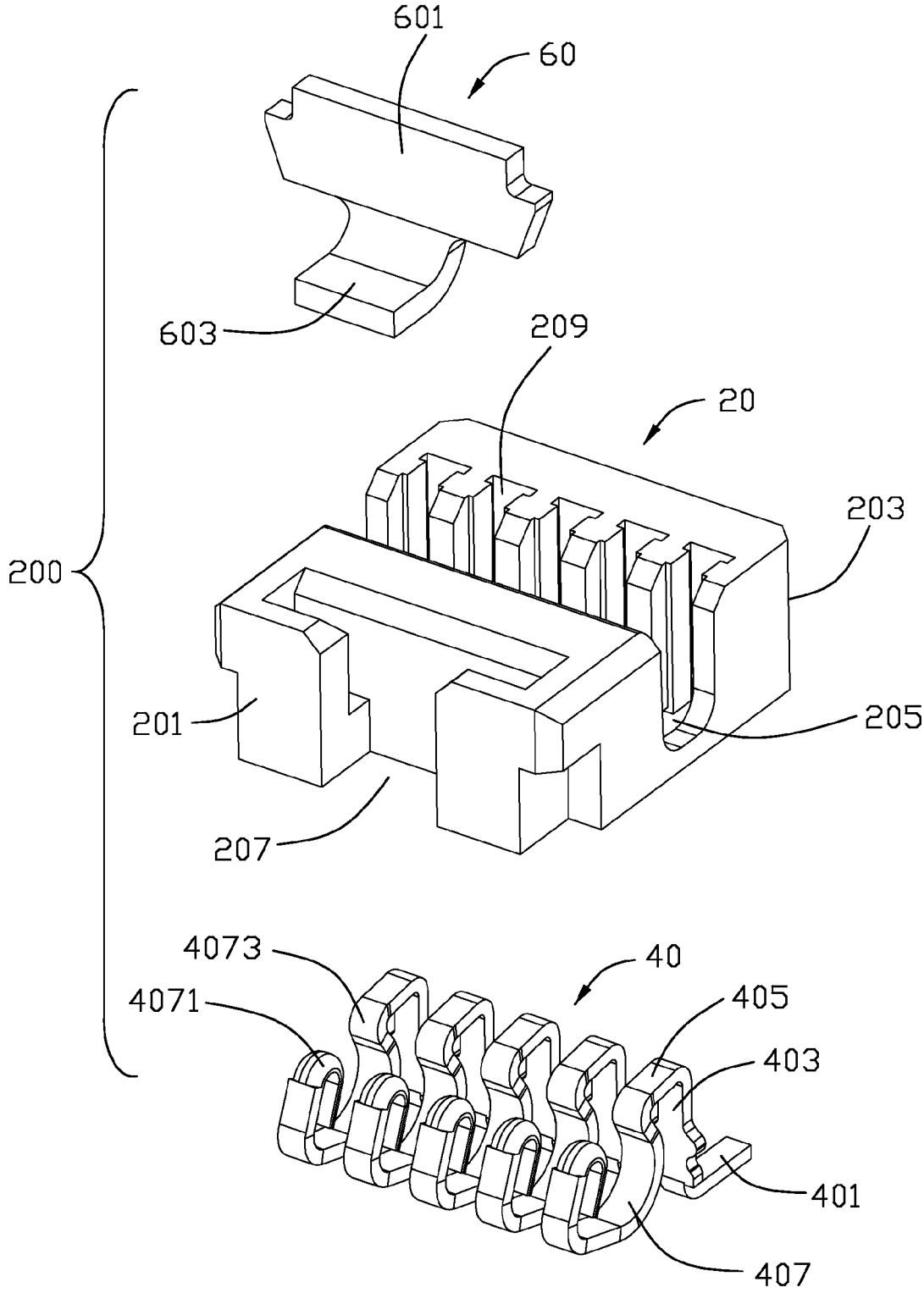
FIG. 9 is a perspective, exploded view of the mating connector of FIG. 1.

Referring to FIGS. 8-9, the insulative base 20 comprises a receiving bar 203 and an assembling bar 201 integrally with the receiving bar 203. The receiving bar 203 defines a receiving room 205 from an upper surface thereof for mating with the cable connector 100 and a plurality of passageways 209 communicating with the receiving room 205. The contacts 40 are partly received in the passageways 209 and partly received in the receiving room 205. The assembling bar 201 defines an approximately T-shaped cut 2011 for receiving the reinforcing element 60. The reinforcing element 60 comprises a transverse arm 601 fully received in the T-shaped cut 2011 and a longitudinal arm 603 slantwise extending from the transverse arm 601 to be partly received in the T-shaped cut 2011 and partly exposed out of the insulative base 20.

Figure 11:
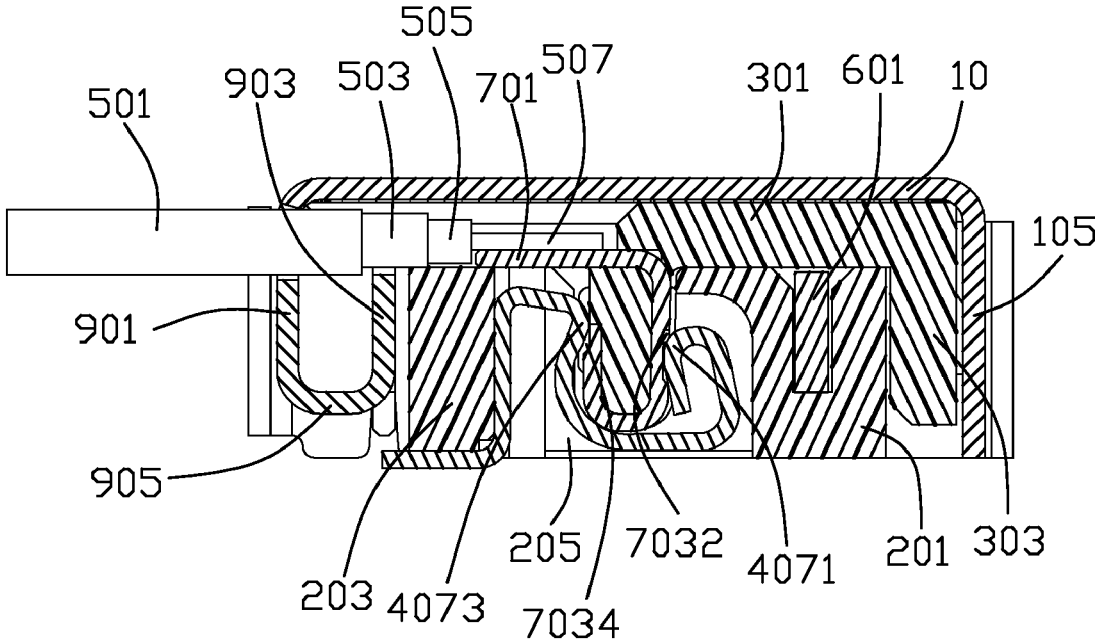
FIG. 11 is a cross-section view of the cable connector assembly of FIG. 10 in which the metal cover of the cable connector is shown.

Referring to FIGS. 8-9 and 11, each contact 40 comprises a soldering part 401 extending horizontally for connection with a printed circuit board (PCB, not shown), a fixing part 403 extending vertically and upwardly from the soldering part 401 for fastening the contact 40 in the insulative base 20, a flexible part 407 curvedly subtending the fixing part 403, and a planar part 405 connecting with the fixing part 403 and the flexible part 407 in a peak position thereof. The soldering part 401, the fixing part 403, and the planar part 405 cooperate with the flexible part 407 to appear as a cap. The flexible part 407 defines a U-shaped receptacle for the receiving terminal 70 of the cable connector 100. The flexible part 407 forms an inflexed part 4073 at a conjoining section with the planar part 405, and a contact part 4071 slantways facing towards the inflexed part 4073 at a free end thereof. In assembling the contact 40 into the insulative base 20, the fixing part 403 is received in the passageways 209 of the insulative base 20 while the contact part 4071 and the inflexed part 4073 are exposed in the receiving room 205 for contacting with the terminal 70 of the cable connector 100.

Figure 10:
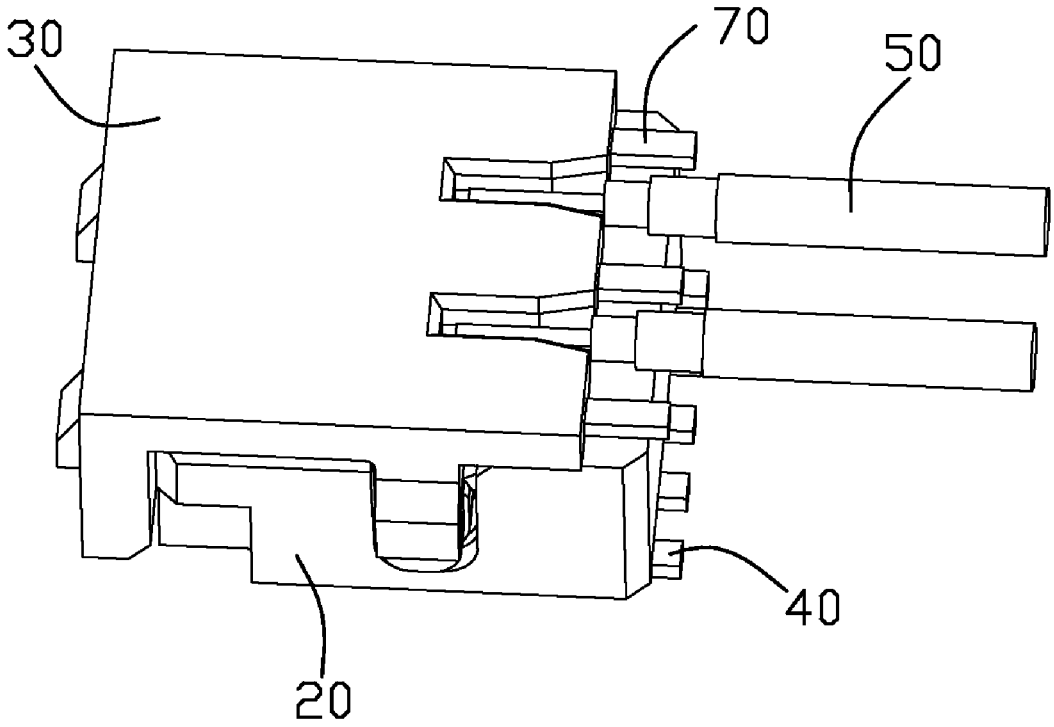
FIG. 10 is a perspective, assembled view of the cable connector assembly according to the prevent invention, without the metal cover of the cable connector.

Referring to FIGS. 10-11, after assembling the cable connector 100 on the mating connector 200, the metal cover 10 fully shields over the mating connector 200. The guiding portion 303 is securely sandwiched between the assembling bar 201 of the insulative base 20 and the rear wall 105 of the metal cover 10. The mating portion 305 of the cable connector 100 and the terminals 70 straddling the mating portion 305 are received in the receiving room 205 of the mating connector 200. In detail, each terminal 70 is inserted into the U-shaped receptacle defined by the flexible part 407 of the contact 40. The contact part 4071 and the inflexed part 4073 are respectively located at different sides of the terminal 70. The contact part 4071 of the contact 40 mechanically and electrically contacts the first contact portion 7032 while the inflexed part 4073 of the contact 40 mechanically and electrically contacts the second contact portion 7034.

The cable connector 100 of the present invention is coupled with the mating connector 200 in a board-to-board manner, the mating connector 200 is soldered with the PCB and the cable connector 100 comprises signal pins 70B, 70D, and a plurality of cables 50 connecting with the signal pins 70B, 70D for signal transmission. Because of the cables 50 are micro coaxial cables, the present invention can transmit high frequent signals. The numbers of the cables 50 and the corresponding signal pins 70B, 70D are two in this embodiment, the present invention alternatively comprises more than two cables 50 and more than two signal pins 70B, 70D to meet with multi-functions of users. Another, because the first and second contact portions 7032, 7034 are both recessed from surfaces of the terminal 70, the contact part 4071 and the inflexed part 4073 of the contact 40 firmly contact with the first and second contact portions 7032, 7034 to prevent deviation therebetween. Moreover, the present invention provides a grounding plate 90 connecting the grounding pins 70A, 70C, 70E, the braiding layers 503 of the cables 50 with the metal cover 10 for grounding purpose. Furthermore, the grounding plate 90 cooperates with the metal cover 10 to position the cables 50 from shaking. Colloid inserted through the interspaces 907 strengthens the position of the cables 50.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. A cable connector, comprising:

an insulative housing;

a plurality of terminals received in the insulative housing, said terminals comprising a plurality of signal pins and a plurality of grounding pins;

a metal cover shielding the insulative housing;

a plurality of cables correspondingly connecting with the signal pins, each cable comprising a central conductor and a braiding layer; and a grounding plate mechanically and electrically connecting with the braiding layers of the cables, the grounding pins and the metal cover, wherein the grounding plate comprises a first plate element, a second plate element extending parallel to the first plate element and a joining element connecting the first and the second plate elements and the first plate element defines a plurality of recesses along an edge thereof and the metal cover defines a plurality of grooves cooperating with the recesses for positioning the cables.

2. The cable connector as described in claim 1, wherein the second plate element abuts against the braiding layers of the cables and the grounding pin.

3. The cable connector as described in claim 2, wherein the metal cover defines a pair of U-shaped cutouts at opposite sides thereof, and the second plate element forms a pair of ear portions received in the corresponding cutouts for connection with the metal cover.

4. The cable connector as described in claim 1, wherein each terminal comprises a soldering portion soldered with the central conductor of the cable and a U-shaped contacting portion extending vertically from the soldering portion.

5. The cable connector as described in claim 4, wherein the soldering portion of the grounding pin is longer than the soldering portion of the signal pin.

6. The cable connector as described in claim 4, wherein the insulative housing comprises a base portion, a mating portion integrally protruding from the base portion, and a plurality of terminal channels receiving the U-shaped contacting portions of the terminals.

7. The cable connector as described in claim 6, wherein the base portion defines a plurality of slits and a plurality of slots and wherein the slits and the slots are alternately arranged and communicating with the terminal channels for receiving the soldering portions of the terminals.

8. The cable connector as described in claim 6, wherein the insulative housing further comprises a guiding portion spaced apart from the mating portion and cooperates with the mating portion and the base portion to define a receiving channel.

9. The cable connector as described in claim 7, wherein the cable extends into the slot to connect with the soldering portion of the signal pin.

10. A cable connector assembly, comprising:

a first connector, comprising:

an insulative housing;

a plurality of terminals including signal pins and grounding pins, received in the insulative housing, each terminal comprising a soldering portion and a contacting portion extending from the soldering portion;

a metal cover shielding the insulative housing;

a plurality of cables each comprising a central conductor connecting with the signal pin and a braiding layer encircling the central conductor; and a grounding plate mechanically and electrically connecting with the braiding layers of the cables, the grounding pins and the metal cover; and a second connector coupled with the first connector, comprising:

an insulative base defining a receiving room and a plurality of passageways communicating with the receiving room;

a plurality of contacts received in the passageways and partly exposed in the receiving room, each contact forming a flexible part defining a receptacle receiving the contacting portion of the terminal, wherein the grounding plate comprises a first plate element, a second plate element extending parallel to the first plate element and a joining element connecting the first and the second plate elements and the first plate element defines a plurality of recesses along an edge thereof and the metal cover defines a plurality of grooves cooperating with the recesses for positioning the cables.

11. The cable connector assembly as described in claim 10, wherein the contacting portion of the terminal of the first connector has two contact portions contacting with the flexible part of the contact.

12. The cable connector assembly as described in claim 10, wherein the contact further has a fixing part subtending the flexible part, a planar part connecting with the fixing part and the flexible part, and a soldering part extending from the fixing part.

13. The cable connector assembly as described in claim 10, wherein the second plate element abuts against the braiding layers of the cables and the grounding pin.

* * * * *